US006007911A

United States Patent [19]

Bowen, Jr.

[11] Patent Number: 6,007,911

[45] Date of Patent: Dec. 28, 1999

[54] INDUSTRIAL FABRICS HAVING FILAMENTS CHARACTERIZED BY FOAM SEGMENTS WITHIN THEIR CROSS SECTION

[76] Inventor: David Bowen, Jr., 9349 Old A1A, St. Augustine, Fla. 32086

[21] Appl. No.: 09/042,370

[22] Filed: Mar. 13, 1998

Related U.S. Application Data

[63] Continuation-in-part of application No. 08/785,218, Jan. 15, 1997, abandoned.

[51] Int. Cl.[6] ..... D02G 3/00; D02D 23/00

[52] U.S. Cl. ..... 428/373; 442/192; 442/189; 442/193; 442/199; 442/200; 442/201; 139/383 A

[58] Field of Search ..... 139/383 A; 442/189, 442/192, 193, 199, 200, 201; 428/314.4, 370, 373

[56] References Cited

U.S. PATENT DOCUMENTS

| | | | |
|---|---|---|---|
| 3,778,994 | 12/1973 | Humphries | 57/149 |
| 4,224,372 | 9/1980 | Romanski | 139/383 A |
| 4,274,448 | 6/1981 | Westhead | 139/383 A |
| 4,300,982 | 11/1981 | Romanski | 162/358 |
| 4,485,141 | 11/1984 | Fujimura | 428/373 |
| 4,544,594 | 10/1985 | Li et al. | 428/92 |
| 4,547,426 | 10/1985 | Montle | 428/377 |
| 4,562,022 | 12/1985 | Li et al. | 264/54 |
| 4,632,716 | 12/1986 | Smith | 139/383 A |
| 4,753,762 | 6/1988 | Li et al. | 264/54 |
| 5,200,261 | 4/1993 | Taguchi et al. | 428/373 |
| 5,361,808 | 11/1994 | Bowen | 139/383 A |
| 5,449,548 | 9/1995 | Bowen | 139/383 A |

*Primary Examiner*—Newton Edwards

[57] ABSTRACT

Industrial fabrics which contain thermoplastic weft or filling filaments characterized by having at least one segment of the filament's cross sectional area consisting of a foamed polymer are described. The unfoamed segment or segments of the filament contribute axial strength while the foamed segment or segments of the filament contribute to radial compressibility. Industrial fabrics utilizing these filaments have reduced permeability, reduced weft denier, and improved fabric rigidity.

8 Claims, 1 Drawing Sheet

INDUSTRIAL FABRICS HAVING FILAMENTS CHARACTERIZED BY FOAM SEGMENTS WITHIN THEIR CROSS SECTION

This application is a CIP of 08/785,218 filed Jan. 15, 1997, which is now abandoned.

BACKGROUND OF THE INVENTION

In industrial processes such as the production of paper, woven, spiral, and especially constructed fabric belts are utilized to support and transport the cellulosic fibers as they are moved through the papermaking process and converted from a thin slurry into finished paper. Mechanical stability and permeability control of these fabric belts are critical to the manufacture of consistent, high quality paper. Paper machines are generally divided into three sections; forming, where thin pulp slurry is partially drained and formed into a thin wet sheet of pulp; pressing, where mechanical pressure is used to squeeze water from the pulp sheet; and drying, where the pulp sheet is heated against hot rolls and converted into a paper sheet. As paper machine speeds have increased, fabrics designed for use in all sections of papermaking machines are increasingly exposed to higher temperatures and more damaging environmental conditions. This is especially true in the dryer section. These more extreme service conditions have caused the useful life of dryer fabrics to be less than satisfactory. An additional problem has recently arisen which is associated with the use of recycled pulp, the presence of oils and inks which stick to the papermaking fabrics and have the potential to cause faults in the paper sheet. The need for affordable, high performance filaments to construct fabrics for use under these more demanding industrial conditions has led to a continuing search for materials and constructions which will improve the service life of industrial fabrics.

DESCRIPTION OF THE PRIOR ART

As the speeds, tensions and environmental conditions in the papermaking process have become more demanding, the fabrics used to transport the paper through the machine have changed from felted material to specialized, high technology fabrics. In U.S. Pat. No. 3,653,961, Lefkowitz gives background on these early changes in paper machine felt materials. The materials of construction have evolved from natural fibers such as cotton or wool to fibers manufactured from polymeric materials such as nylon, polyester and polyphenylene sulfide. The general term "felt" is still used, even though most paper machine fabrics are now of woven or spiral design and construction. No completely satisfactory single material has yet been found to meet current demands of performance, cost and durability for fibers used in these fabrics. Polyhexamethylene adipamide (Nylon-66), for example, is very good in wear resistance, hydrolytic stability, heat stability and cost, but is not dimensionally stable under conditions found in modern paper machine dryers. Polyesters such as polyethylene terephthalate (PET) have good dimensional stability, but even with addition of carbodiimide stabilizers, depolymerization by hydrolysis is still above acceptable levels. Polyphenylene sulfide (PPS) has very good resistance to heat and hydrolysis, but poor wear performance and poor flexibility which leads to unsatisfactory knot strength performance.

In U.S. Pat. No. 5,405,685, Patel describes some of these problems and proposes use of fibers based on use of a polyethylene naphthalate (PEN) polyester or blends of PEN with other polymers with special emphasis on overcoming hydrolytic degradation. Patel also cites U.S. Pat. No. 5,169,499 as describing a copolyester of 1,4-dimethylolcyclohexane, terephthalic acid and isophthalic acid PCTA) as an attempt to overcome use problems under paper machine dryer conditions. PCTA has been found to have significant degradation problems under dry heat conditions found in modern paper dryers.

In U.S. Pat. No. 5,104,724, Hsu claims the use of fibers made from polyetheretherketone (PEEK) to construct dryer fabrics. This polymer does appear to meet all the performance requirements listed above, but suffers in practical applications from its extremely high cost.

In U.S. Pat. No. 5,230,371 and U.S. Pat. No. 5,343,896, Lee et. al. describe an approach to improved fabric life where the dryer fabric is constructed in "layers" from the paper side to the exterior and where different polymers are used for the fibers of the separate layers. For example, one fabric description utilized Nylon-66 fibers (hydrolysis resistance and good wearability) for the fabric's paper side, PET fibers (dimensional stability) for the machine side and PPS fibers (heat and hydrolysis resistance) for the interior weft fibers of the fabric.

In U.S. Pat. No. 4,202,382, Westhead describes an approach to improved fabric durability where the fibers are constructed with a core fiber wraped with an aramid fiber. PET is given as an example of core fiber and Nomex and Kevlar, products of the DuPont de Nemours & Company, are used as the wrappnmg fibers.

In U.S. Pat. Nos. 5,361,808 and 5,449,548, Bowen teaches the use of shaped fibers for specific flexibility requirements and for economy of material use.

In U.S. Pat. Nos. 4,544,594, 4,562,022 and 4,753,762, Li et. al. disclose the use of foamed nylon and polyester fibers having a density between 40 and 85 per cent of the normal density of solid fibers. The teachings of these patents relating to foamed filaments are included into this application by reference. The necessity to maintain pressure in the extruder and spin pack above the saturation point of the foam producing gas in the polymer is emphasized. In U.S. Pat. No. 4,753,762, the use of closed cell forming additives is discussed and the use of polymeric cross linkers to increase melt strength for foam formation is known in the industry.

Hollow fibers have been used with mixed success in an attempt to produce yarns which have reduced mass for a given outer or apparent diameter. When these hollow fibers get much larger than about 0.50 mm in diameter, they often have a fibrillation problem and are therefore unsuitable for use in physically demanding end uses. Fibrillation results most often when the hollow fiber is flattened and rubbed along its axial direction.

Another very interesting fiber is produced by Asten, Inc. which has a core of multifilament polyester yarn which has been subsequently covered by a sheath of nylon. This fiber is very flexible, conforms easily into the fabric and has excellent durability properties.

In business areas unrelated to paper production, use of simultaneously extruded sheath core and bicomponent fibers has been used to achieve specific properties not available from a single polymer. For example, a sheath of lower melting polymer extruded over a higher melting polymer may be used to form fibers which can be fused together into shaped articles by application of heat. U.S. Pat. No. 5,284,704 by Kochesky et. al. is an example of this sheath core technology. Another example of sheath core technology may be found in the production of tire yarn, where Nylon-66 is extruded over PET to achieve good rubber adhesion and high fabric stability. U.S. Pat. No. 5,468,555 by Lijten is a good example of this type process. In U.S. Pat. No. 5,617,903, Bowen teaches the use of multipolymeric fibers having both sheath core and "islands in the stream" designs for use in industrial fabrics. The teachings of multicomponent spinning from this patent are incorporated into this application by reference.

In U.S. Pat. No. 4,485,141, Fujimura et. al. teach a polypropylene bicomponent fiber having a foamed sheath which has open cells in the sheath.

A very important property of industrial fabrics used in the paper industry is the permeability. This is a measurement of the volumetric flow of air through a one foot square area of the fabric under a pressure of 0.50 inches of water pressure.

There remains a need for weft or filling filaments which have a better combination of cost, radial compressibility, axial strength and acceptable resistance to environmental degradation.

SUMMARY OF THE INVENTION

This invention provides papermaker's and industrial fabrics which contain 15 percent or more of new and novel melt spun weft or filling filaments produced on multi-component spinning equipment, larger than 100 denier, comprised of polymers having a melt point above 210 degrees centigrade and containing at least one foamed segment within the filament cross section. The foamed segment or segments will occupy from 15 to 85 per cent of the filament's cross sectional area and the foamed segments will contain a volume percentage of from 15 to 85 per cent closed cell gaseous bubbles. The foamed segment will provide radial compressibility needed to give low fabric permeability and interlocking with the warp fibers for improved fabric rigidity. The unfoamed segment of the filaments cross section will provide the axial strength to give the fabric it's required mechanical properties. The chief benefit of such filament designs are that they can be manufactured by using a novel combination of known technologies. One filament design with good applications would be a sheath-core structural arrangement. A non-limiting example could have a sheath comprised from any fiber forming thermoplastic suitable for use under papermakering dryer conditions (hydrolysis stabilized PET), and a core comprised of a fiber forming thermoplastic (PET) which has been modified to include 40 volume per cent or more of gaseous bubbles. Another filament design with good applications would be a 0.50 mm diameter monofilament having an islands in the stream design and consisting of heat stabilized nylon 66 polymer. The stream polymer would contain normal additive levels and make up 50 per cent of the filament's cross sectional area. The islands polymer would also be heat stabilized nylon 66 and would be foamed to contain 50 per cent gaseous bubbles. The spinning process could be designed to form from two to forty islands. Denier of the resulting filament would be 75 per cent of a solid fiber of the same diameter and the bubble containing segments would give the filament radial compressibility. Axial strength would primarily be provided by the unfoamed segment, but the foamed segment wold also contribute to axial strength. Radial compressibility provided by the foamed segment would allow the filament to more closely conform into the interstitial spaces of the fabric into which it was woven. While providing radial compressibility, the foamed segment or segments would also provide some mechanical strength and reduce the tendency of the filament to crush and fibrilate. Fabric rigidity is enhanced by the foamed filaments radial compressibility. The indentations produced in the foamed filaments during fabric production serve to help lock the fabric filaments together.

It is emphasized that the filaments of this invention need not be round, only that they have foamed and unfoamed segments within their cross section.

DETAILED DESCRIPTION OF THE INVENTION

Figure 1:
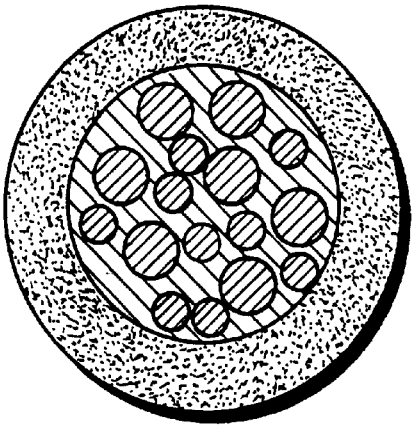
FIG. 1. is a cross section of a circular sheath core fiber with the interior polymer segment foamed and the sheath segment consisting of an unfoamed polymer. The relative proportions of the foamed and unfoamed segments can vary from 85/15 to 15/85. The fiber shown has approximately 50 per cent of its cross section foamed.
Figure 2:
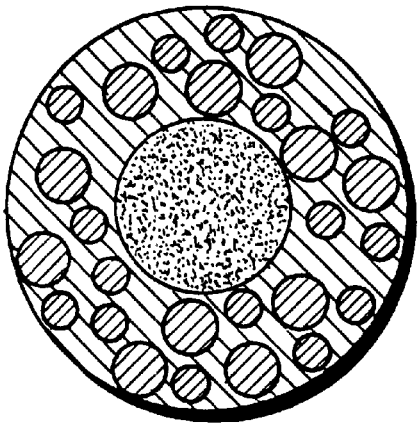
FIG. 2. is a cross section of a circular sheath-core fiber having a solid thermoplastic polymer center segment and a foamed outer sheath segment.
Figure 3:
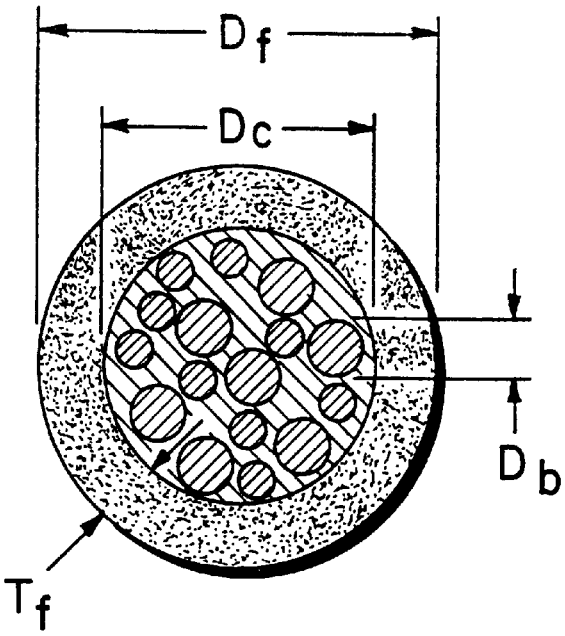
FIGS. 3. shows some of the representative dimensions which may be used to describe multi-segment cross sectional filaments. Df is used for the overall filament diameter. Dc is used for the filament's core diameter. Tf is used for the sheath thickness, which is also Df–Dc. Db is the diameter of an individual bubble.
Figure 4:
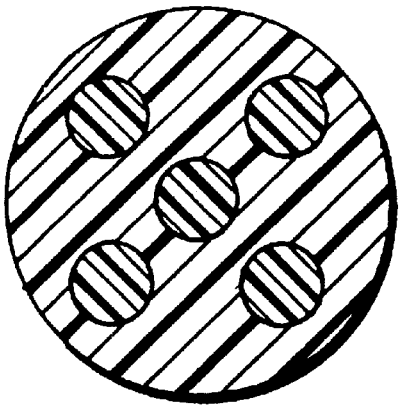
FIG 4. shows an islands in the stream design with 5 islands. Either the stream segment or the islands segments could be foamed.

This invention is a result of a new and novel combination of the concepts of the soft radially deformable Asten, Inc. fiber with a nylon sheath over a core of polyester tire cord and included air, the Li et.al. idea of using foamed filaments, and the well known art of multi-component fiber production. Polymers used in the invention will be in the class generally known as thermoplastic engineering polymers, have the melt strength to be fiber forming and have a melt point above 210 degrees centigrade. The new concept overcomes the axial strength and fibrillation problems of the foamed filaments described by Li et.al. by having a portion of the filament (the sheath, the core, islands or the stream) with normal fiber forming polymer properties. Filament formation and processing problems often occur whenever filaments are produced from polymers contaning over 10 per cent non polymeric materials. In the case of foamed filaments, one of the main problems is that a single instance of a bubble with a size approaching 20 per cent of the filament diameter will usually cause the filament to break during spinning and drawing processes. The inability to prevent such processing disruptions has led to limited use of foam containing filaments. This new technology overcomes this filament production problem by having a segment of unfoamed polymer to provide necessry mechanical performance. It is not necessary that the polymers used within the filaments of the invention be different, only that one segment of the filament's cross sectional area have a fiber forming thermoplastic with "normal" (usually less than 10 volume %) levels of additives, pigments etc. and that at least one other segment of the filament's cross sectional area contain between 15 and 85 volume per cent of gaseous bubbles. The segment containing the gaseous bubbles will be referred to as the foamed segment.

The cost of producing multicomponent filaments is higher than that of producing monocomponent fibers primarily in the initial machine cost. Usually two melt extrusion systems are utilized to provide the separate polymer melts. The two (or more) melts are combined in a multicomponent spin pack to provide the targeted final filament product configuration; side by side, sheath core or islands in the stream. After this investment is made, the potential for production of superior fibers is often realized and exploited. For example, if $1,000,000 extra is invested for a 6 inch extruder bicomponent spinning machine which produces 600 lb. per hour, the bicomponent equipment cost would add only about $0.05 per pound to product cost. Hills Inc. of Melbourne, Fla. produces such machines and provides equipment for experimental runs.

Preferred Embodiments of the Invention:

EXAMPLE 1

Solutia™ type 45AX nylon 66 polymer was spun utilizing the Hills Inc. bicomponent research machine. One side of the bicomponent machine was set to provide the sheath and the temperature profile was set to give 280, 290, 285 and 285 degrees centigrade in the feed, melt, compression and feed zones of the extruder respectively. The other side of the machine was set to provide the core and the temperature profile was initially set as described above. After the machine had reached operationg conditions, 1.0 weight per cent Reedy International Corp. Safoam™ RPC-40 blowing agent was added to the core polymer and the temperature profile of the core extruder was reduced to 283 and 280 degrees in the compression and feed zones respectively. Careful attention was paid to keep pressures above 2000 psi in all zones prior to the spinneret capillary. This was necessary to prevent premature dissolution of the nitrogen and CO2 from the polymer melt. Low pressures will result in large bubbles which will give poor fiber properties. Sheath core fibers were produced which had uniform small closed cell bubbles in the core. Bubble volume was 20 per cent of the core cross sectional area. It was found that better results were achieved when the spinneret to quenching water bath distance did not exceed 3 inches. Distances greater than this would sometimes lead to collapse of the bubbles and rough fiber surfaces.

EXAMPLE 2

The same setup as in 1 above was made except that 1.5 weight per cent of Safoam™ was added to the core polymer. A sheath core filament was produced which had a foam core with 40 per cent closed cell gaseous bubbles.

EXAMPLE 3

The setup as in 1 above was used, except that the spin pack arrangement was changed to produce an islands in the stream design and the islands' polymer was changed to Dow Chemical Company's Questra™ polypropylene which has a melt point of about 270 degrees centigrade. When 1 weight per cent Safoam™ was added to the Questra™, foamed islands were produced. While the individual island density was not measured, overall filament density indicated an average closed cell gaseous bubble content for the islands at about 20 per cent.

Samples of the fiber produced in preferred embodiment 2 above were subjected to a draw ratio of 3.5 to result in a fiber 0.5 mm in diameter. Denier was 1500 and the tenacity was 2.5 gram per denier. The outside surface was smooth and could be compressed with moderate force.

Safoam™ blowing agent acts by decomposing into CO2 and nitrogen. Direct CO2 injection or use of vaporizing chemicals are other known methods of producing polymeric foams. Use of nucleating agents such as TiO2 and talc are also known to improve foam uniformity.

For fibers which include foaming, use of high melt strength polymers or use of additive packages to increase melt strength of the polymer to be foamed is known to be of value in obtaining good performance on fiber spinning lines. Lowering the melt temperature is also an acceptable alternative for some plastics to maintain acceptable melt strength since some foaming agents lower polymer viscosity while in solution with the polymer.

EXAMPLE 4.

A woven fabric having 50 polyester 0.52 by 0.36 mm warp fibers per inch and 32 polyester 0.50 mm round weft filament picks per inch was woven on a standard industrial weaving machine. Fabric permeability was determined to be 400 cfm. Denier of the weft fibers was 2500.

EXAMPLE 5.

A woven fabric as in 4 above was prepared, except that the weft fibers were 0.55 mm diameter nylon 66 filaments consisting of a 0.38 mm diameter core foamed to 50 per cent and a 0.085 mm thick sheath. Fabric permeability was measured at 325 cfm. Denier of this weft was 1950, a 22 per cent reduction over the denier of the weft used in example 4 and with a significant reduction in fabric permeabity.

EXAMPLE 6.

A woven fabric as in 4 above was prepared except that the weft filaments are 0.55 mm diameter nylon-66 filaments having an islands in the stream design. The stream was regular 55 RV solid polymer and there were 15 islands in the design. The islands polymer was foamed to 50 per cent and was also 55 RV nylon-66. Weft filament denier was 1825 and fabric permeability was 360 cfm.

What is claimed is:

1. An industrial fabric which contains more than 15 per cent melt spun weft or filling filaments larger than 100 denier, produced by multi-component spinning equipment, comprising:

a) polymer which has a melt point above 210 degrees centigrade, b) a filament structure characterized by having a cross section divided into a sheath segment and a core segment, c) said sheath segment occupying from 15 to 85 per cent of said weft or filling filaments' total cross sectional area, d) one of said sheath segment or core segment comprising a foamed polymeric segment having a volume percentage of from 15 to 85 per cent closed cell gaseous bubbles, e) said weft or filling filaments having axial strength furnished by the unfoamed segment and radial compressibility furnished by said foamed segment, whereby reduced fabric permeability, reduced weft or filling filament denier, and improved fabric rigidity are realized.

2. The industrial fabric of claim 1, where the denier of the weft or filling filaments having a foamed segment is at least 500.

3. The industrial fabric of claim 1, where the same polymer is used to produce the sheath segment and the core segment of the weft or filling filaments having a foamed segment.

4. The industrial fabric of claim 1, where different polymers are used to produce the sheath segment and the core segment of the weft or filling filaments having a foamed segment.

5. An industrial fabric which contains more than 15 per cent melt spun weft or filling filaments larger than 100 denier, produced by multi-component spinning equipment, comprising:

a) polymer which has a melt point above 210 degrees centigrade, b) a filament structure characterized by having a cross section generally known as an islands in the stream design, containing islands segments and a stream segment, c) said stream segment of said islands in the stream design occupying from 15 to 85 per cent of said filament's cross sectional area, d) either said stream segment or said islands segments of said filaments comprising a foamed polymeric segment or segments having a volume percentage of from 15 to 85 per cent closed cell gaseous bubbles, e) said weft or filling filaments having axial strength furnished by the unfoamed segment or segments and radial compressibility furnished by said foamed segment or segments, whereby redued fabric permeability, reduced weft or filling filament denier, and improved fabric rigidity are realized.

6. The industrial fabric of claim 5, where the denier of the weft or filling filaments having a foamed segment is at least 500.

7. The industrial fabric of claim 5, where the same polymer is used to produce the stream segment and the islands segments of the weft or filling filaments having a foamed segment.

8. The industrial fabric of claim 5, where different polymers are used to produce the stream segment and the islands segments of the filaments having a foamed segment.

* * * * *